US009362104B2

(12) United States Patent
Mamizuka et al.

(10) Patent No.: US 9,362,104 B2
(45) Date of Patent: Jun. 7, 2016

(54) SHORT ARC TYPE DISCHARGE LAMP

(71) Applicant: USHIO DENKI KABUSHIKI KAISHA, Tokyo (JP)

(72) Inventors: Masataka Mamizuka, Hyogo (JP); Atsushi Kato, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/522,113

(22) Filed: Oct. 23, 2014

(65) Prior Publication Data

US 2015/0115844 A1 Apr. 30, 2015

(30) Foreign Application Priority Data

Oct. 25, 2013 (JP) ..... 2013-221726

(51) Int. Cl.
*H01J 65/04* (2006.01)

(52) U.S. Cl.
CPC ..... *H01J 65/04* (2013.01)

(58) Field of Classification Search
CPC ..... H01J 61/52; H01J 61/30; H01J 61/86; H01J 61/12; H01J 65/044; H01J 61/025; H01J 7/46
USPC ..... 313/25, 46, 111–114, 146, 151; 362/263, 293, 294, 296, 297, 310, 345, 362/346, 308; 359/360, 589
See application file for complete search history.

(56) References Cited

U.S. PATENT DOCUMENTS

| | | | | |
|---|---|---|---|---|
| 4,633,128 | A * | 12/1986 | Roberts et al. | 313/113 |
| 5,903,088 | A * | 5/1999 | Sugitani et al. | 313/46 |
| 6,561,675 | B1 * | 5/2003 | Kavanagh | 362/263 |
| 2005/0206319 | A1 * | 9/2005 | Botzer et al. | 313/634 |

FOREIGN PATENT DOCUMENTS

JP S61-267253 A 11/1986

* cited by examiner

*Primary Examiner* — Alexander H Taningco
*Assistant Examiner* — Seokjin Kim
(74) *Attorney, Agent, or Firm* — Michael Best & Friedrich LLP

(57) ABSTRACT

Provided is a short arc discharge lamp that includes: a body including therein a reflection surface and having a front opening; a cathode and an anode opposed to each other in discharge space defined by the reflection surface surrounding the discharge space; a window member provided in front of the body and covering the front opening; and a window supporting member including an inner ring section, an outer ring section, and a coupling section. The inner ring section is configured to allow a circumferential side surface of the window member to be fixed thereto, the outer ring section is larger in diameter than the inner ring section, and the coupling section connects the inner ring section and the outer ring section together. The inner ring section includes, in front of the window member, a front edge section having a shape bent in a radial direction of the window member.

13 Claims, 2 Drawing Sheets

Related Art

SHORT ARC TYPE DISCHARGE LAMP

CROSS REFERENCE TO RELATED APPLICATIONS

This application claims the benefit of Japanese Priority Patent Application JP2013-221726 filed on Oct. 25, 2013, the entire contents of which are incorporated herein by reference.

BACKGROUND

The invention relates to a short arc discharge lamp having a body.

One type of a short arc discharge lamp (hereinafter simply referred to as a "discharge lamp") is known in which a lamp body (hereinafter simply referred to as a "body" is formed of an opaque insulating member and only a portion where light is to be extracted is formed of a translucent member. For example, reference is made to Japanese Unexamined Patent Application Publication No. S61-267253.

FIG. 4 is a cross-sectional view for describing an example of a configuration of a discharge lamp. The discharge lamp is provided with a body 40 and a window member 50. The body 40 includes therein a reflection surface 40*a* curved in a concave shape, and the window member 50 covers a front opening 40*b* of the body 40. The reflection surface 40*a* of the body 40 defines discharge space S surrounded by the reflection surface 40*a* and in which a cathode 42 and an anode 43 are disposed to oppose each other.

The window member 50 is supported by a ring-shaped flange 55. The ring-shaped flange 55 has a U-shaped cross-section, and includes an inner ring section 55*a*, an outer ring section 55*b*, and a coupling section 55*c*. The inner ring section 55*a* is tubular in shape, the outer ring section 55*b* is tubular in shape and is larger in diameter than the inner ring section 55*a*, and the coupling section 55*c* connects the inner ring section 55*a* and the outer ring section 55*b* together.

The window member 50 is fitted into the ring-like flange 55 and thus supported by the ring-like flange 55 such that a circumferential side surface of the window member 50 is brought into contact with an inner circumferential surface of the inner ring section 55*a* of the ring-shaped flange 55 through an unillustrated bonding layer.

A window assembly 56 formed by the window member 50 and the ring-shaped flange 55 supporting the window member 50 is provided in the front of the body 40 through a ceramic spacer ring 46 and a metal ring 45. The metal ring 45 serves to supply power to the cathode 42. The window assembly 56, the ceramic spacer ring 46, and the metal ring 45 are fitted together with the body 40 into a cylindrical first metal tubular body 48, thereby fixing the window assembly 56 to the body 40.

In FIG. 4, a reference numeral 47 denotes a conductive supporting member for disposing the cathode 42 at a predetermined position, and a reference numeral 49 denotes a second metal tubular body for fixing the body 40 to a metal block 41.

SUMMARY

What is desired in a discharge lamp is to suppress generation of damage, crack, or the like of a window member.

It is desirable to provide a short arc discharge lamp capable of suppressing generation of damage, crack, or the like of a window member.

A short arc discharge lamp according to an embodiment of the invention includes: a body including therein a reflection surface and having a front opening; a cathode and an anode that are opposed to each other in discharge space, in which the discharge space is defined by the reflection surface surrounding the discharge space; a window member provided in front of the body and covering the front opening; and a window supporting member including an inner ring section, an outer ring section, and a coupling section. The inner ring section is configured to allow a circumferential side surface of the window member to be fixed thereto. The outer ring section is larger in diameter than the inner ring section. The coupling section connects the inner ring section and the outer ring section together. The inner ring section includes, in front of the window member, a front edge section having a shape bent in a radial direction of the window member.

Advantageously, the window member may be disposed in the front of the body through a metal ring. The metal ring may be configured to supply power to the cathode.

Advantageously, the coupling section of the window supporting member may be fixed to the metal ring.

Advantageously, the window supporting member may have a ring shape having a U-shaped cross-section.

Advantageously, the circumferential side surface of the window member may be fixed to the inner ring section of the window supporting member through a bonding layer.

Advantageously, the shape of the front edge section may include a shape bent inwardly or outwardly in the radial direction of the window member.

Advantageously, the reflection surface may be curved in a concave shape.

Advantageously, the inner ring section may be tubular in shape, and the outer ring section may be tubular in shape.

Advantageously, the front edge section may be in indirect contact with the window member.

Advantageously, the front edge section may be formed as a result of performing a bending process on a material that forms the inner ring section.

According to the short arc discharge lamp in any of the above-described embodiments of the invention, the inner ring section of the window supporting member includes, in the front of the window member, the front edge section having the shape bent in the radial direction of the window member. Thus, the window member is not protruded forward, making it difficult to cause damage on the window member even when the discharge lamp is placed on a table or the like with the window member facing down. Also, the window supporting member having the front edge section provides the window supporting member itself with increased strength, making it difficult for the window supporting member to be deformed. Hence, it is possible to suppress application of a tensile stress to the window member even in the operation of the discharge lamp, and thereby to suppress generation of damage, crack, or the like of the window member.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate some example embodiments and, together with the specification, serve to explain the principles of the invention.

DETAILED DESCRIPTION

Some example embodiments of the invention are described in detail below with reference to the accompanying drawings.

Figure 1:
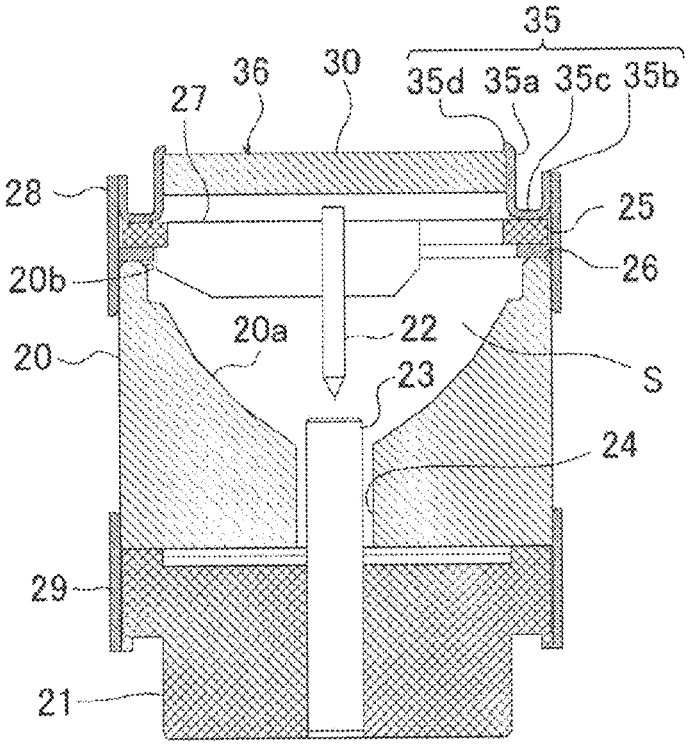
FIG. 1 is a cross-sectional view illustrating an example of a configuration of a short arc discharge lamp according to an embodiment of the invention.
Figure 2:
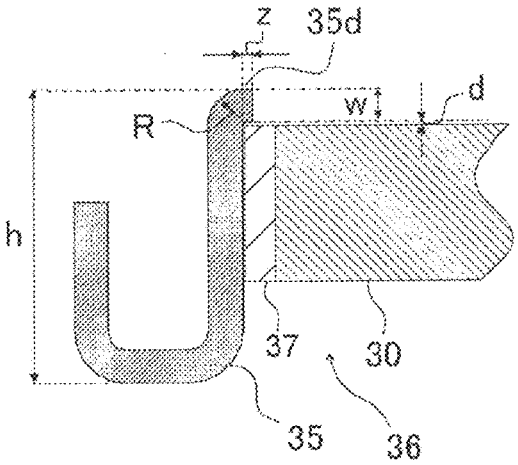
FIG. 2 is a cross-sectional view illustrating part of a window supporting member of the short arc discharge lamp illustrated in FIG. 1 in an enlarged fashion.

FIG. 1 is a cross-sectional view illustrating an example of a configuration of a short arc discharge lamp (hereinafter simply referred to as a "discharge lamp") according to an embodiment of the invention. FIG. 2 is a cross-sectional view illustrating part of a window supporting member of the discharge lamp illustrated in FIG. 1 in an enlarged fashion.

The discharge lamp is provided with a body 20 and a window member 30. The body 20 may be cylindrical in outer shape and includes therein a reflection surface 20*a* which may be curved in a concave shape. The window member 30 covers a front opening 20*b* of the body 20. The reflection surface 20*a* of the body 20 defines discharge space S surrounded by the reflection surface 20*a* and in which a cathode 22 and an anode 23 are provided. The cathode 22 and the anode 23 may be disposed to oppose each other at a focal position of the reflection surface 20*a* with a gap interposed therebetween, and extend along an optical axis of the reflection surface 20*a*. The body 20 may be supported by a metal block 21.

For example, the window member 30 may have a disk-like shape, and made of a light-transmissive material such as, but not limited to, sapphire.

The window member 30 is supported by a window supporting member 35. The window supporting member 35 may have a U-shaped cross-section, and includes an inner ring section 35*a*, an outer ring section 35*b*, and a coupling section 35*c*. The inner ring section 35*a* may be tubular in shape, and may have an inner diameter that fits in with an outer diameter of the window member 30. The outer ring section 35*b* may be tubular in shape and larger in diameter than the inner ring section 35*a*. The coupling section 35*c* connects the inner ring section 35*a* and the outer ring section 35*b* together.

The window member 30 may be fitted into the window supporting member 35 and thus supported by the window supporting member 35 such that a circumferential side surface of the window member 30 is brought into contact with an inner circumferential surface of the inner ring section 35*a* of the window supporting member 35 through a bonding layer 37.

A window assembly 36 formed by the window member 30 and the window supporting member 35 supporting the window member 30 may be provided in the front of the body 20 through a ceramic spacer ring 26 and a metal ring 25. The metal ring 25 serves to supply power to the cathode 22, and may be made of, for example but not limited to, kovar (Registered Trademark of Carpenter Technology Corporation located in Wyomissing, Pa.).

The outer ring section 35*b* may be connected to the inside of the first metal tubular body 28 by a method such as, but not limited to, welding. The first metal tubular body 28 may be cylindrical in shape, and may have an inner diameter that fits in with an outer diameter of the body 20. The first metal tubular body 28 may be made of, for example but not limited to, kovar. Further, the coupling section 35*c* may be fixed to the metal ring 25. With this configuration, the window assembly 36 is fixed to the body 20, and air-tightness in the discharge space S is maintained.

Inside the discharge space S is inert gas sealed therein. The inert gas may be, for example but not limited to, xenon gas.

In the window supporting member 35 of the discharge lamp according to the example embodiment of the invention, the inner ring section 35*a* is provided with a front edge section 35*d* in the front of the window member 30. The front edge section 35*d* has a shape that may be bent inwardly in a radial direction of the window member 30.

The front edge section 35*d* is not in contact with the window member 30. The indirect contact of the front edge section 35*d* to the window member 30 suppresses direct application to the window member 30 of a stress applied from the window supporting member 35.

In one embodiment, the front edge section 35*d* may be formed by performing a bending process on a material to be formed into the inner ring section 35*a*.

The circumferential side surface of the window member 30 is subjected to metalization process and is thus covered with a metal. The metal may include, for example but not limited to, a mixture of molybdenum and manganese.

The bonding layer 37 bonds the window member 30 and the window supporting member 35 together, and may be formed by an adhesive. The adhesive may be a brazing material such as, but not limited to, a silver brazing material.

The body 20 may be made of an insulating material such as, but not limited to, polycrystalline alumina ($Al_2O_3$) or ceramics. The reflection surface 20*a* of the body 20 may be, for example but not limited to, parabolic, elliptical, or aspheric in shape.

The reflection surface 20*a* may be formed by, for example but not limited to, a metal vapor-deposition film or a dielectric multilayer film. The metal vapor-deposition film may include, for example but not limited to, silver or aluminum.

The body 20 is subjected to metalization as with the window member 30, and is bonded to the first metal tubular body 28 and a second metal tubular body 29 by a brazing material such as, but not limited to, a silver brazing material.

The metal block 21 may be made of a metal having high electric conductivity and heat conductivity, and may have an outer diameter equal to that of the body 20. The metal of the metal block 21 may be, for example but not limited to, a kovar metal containing, as a major component, iron which is high in electric conductivity and heat conductivity.

The body 20 may be connected, together with the metal block 21, to the inside of the second metal tubular body 29 by a method such as, but not limited to, welding, to be thus fixed to the metal block 21. The second metal tubular body 29 may be cylindrical in shape, and may have an inner diameter that fits in with the outer diameter of the body 20.

The cathode 22 may be disposed such that the tip portion thereof is opposed to a tip of the anode 23 in the discharge space S, whereas a base end portion of the cathode 22 may be supported by three conductive supporting members 27 that may be provided at even intervals on the circumference of the metal ring 25, for example.

The conductive supporting members 27 may be each made of a material such as, but not limited to, molybdenum in view of heat resistance and welding properties, and may be disposed to extend inwardly in a radial direction of the metal ring 25 in the discharge space S. Each of the conductive supporting members 27 may have a tip portion welded to the base end portion of the cathode 22 by a method such as, but not limited to, brazing, and a base end portion fixed to the metal ring 25 by a method such as, but not limited to, brazing.

The cathode 22 is electrically connected to the outside through the conductive supporting members 27, the metal ring 25, and the first metal tubular body 28, while maintaining air-tightness by virtue of the welding.

The cathode 22 may be a substantially columnar member including a tapered tip portion having a diameter that decreases as it approaches a tip of the cathode 22. The cathode 22 may be made of a high melting point metal that contains a substance easy to emit electrons, such as, but not limited to, tungsten.

The anode 23 may be disposed such that a base end portion of the anode 23 is inserted into an electrode rod hole 24 formed on the body 20 and the metal block 21 along an optical axis of the body 20, whereas the tip portion of the anode 23 may be disposed to oppose the cathode 22 in the discharge space S.

The anode 23 is electrically connected to the outside through the metal block 21, while maintaining air-tightness by virtue of the welding.

In one embodiment, the discharge lamp may contain the inert gas such as, but not limited to, xenon that may be filled in the discharge space S at a pressure of 20 MPa, and may have a rated current of 20 ampere and power consumption of 300 watts.

Non-limiting examples as to dimensions of the discharge lamp in one embodiment may include: 20 mm for an overall length of the body 20 and 32 mm for an outer diameter thereof; 14 mm for an overall length of the cathode 22, 1.5 mm for a rod diameter thereof, and 50 degrees for a taper angle of the tip thereof; 23 mm for an overall length of the anode 23 and 4 mm for a diameter thereof; 1.4 mm for an inter-electrode distance between the anode 23 and the cathode 22; 24.89 mm for an outer diameter of the window member 30 and 3 mm for a thickness thereof; 0.7 mm for a distance from a front end of the window supporting member 35 to the window member 30; 5.65 mm for a height "h" of the window supporting member 35; 31.5 mm for an outer diameter of the outer ring section 35*b;* 26.3 mm for an outer diameter of the inner ring section 35*a;* 0.65 mm for a thickness "w"; R0.5 to R1.2 for a radius of the bending process of the front edge section 35*d;* 0.2 mm for a width "z" of the front edge section 35*d*; and 0.05 mm for a distance "d" between a light emission surface of the window member 30 and an inner surface of the front edge section 35*d* of the window supporting member 35.

In the discharge lamp according to the present embodiment of the invention, the inner ring section 35*a* of the window supporting member 35 includes, in the front of the window member 30, the front edge section 35*d* having the shape bent inwardly in the radial direction of the window member 30. Thus, the window member 30 is not protruded forward, making it difficult to cause damage on the window member 30 even when the discharge lamp is placed on a table or the like with the window member 30 facing down. Also, the window supporting member 35 having the front edge section 35*d* provides the window supporting member 35 itself with increased strength, making it difficult for the window supporting member 35 to be deformed. Hence, it is possible to suppress application of a tensile stress to the window member 30 even in the operation of the discharge lamp, and thereby to suppress generation of damage, crack, or the like of the window member 30. In this regard, a description is provided below based on a comparison between the discharge lamp according to the present embodiment and that illustrated in FIG. 4.

Figure 4:
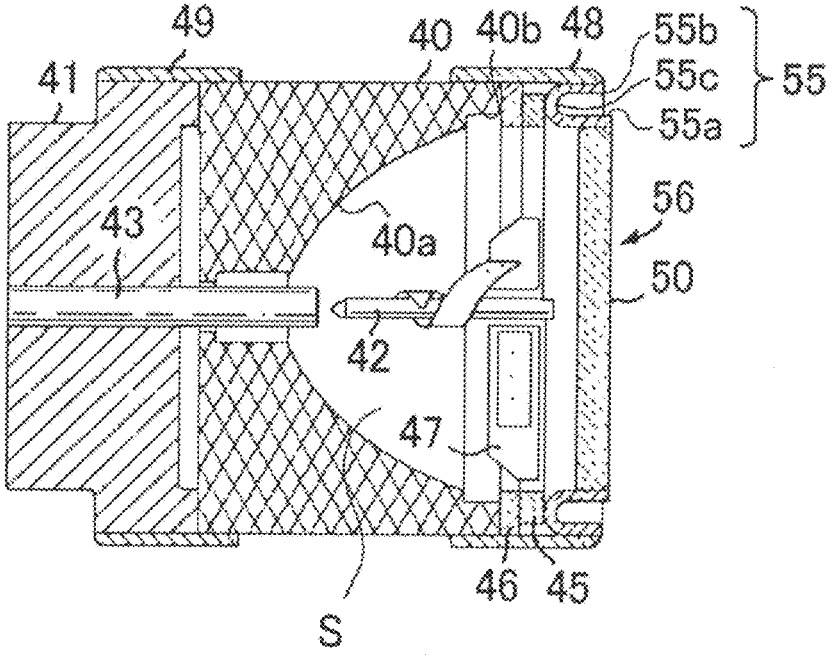
FIG. 4 is a cross-sectional view for describing an example of a configuration of a short arc discharge lamp.

In the discharge lamp having the configuration as illustrated in FIG. 4, the front edge end of the inner ring section 55*a* of the ring-shaped flange 55 is recessed from (i.e., in FIG. 4, located more leftward than) the window member 50. This may cause damage when the discharge lamp is placed on a table or the like with the window member 50 facing down, which may in turn result in crack upon operation of the discharge lamp, and may result in breakage of the discharge lamp accordingly.

To address such circumstances, a configuration of a discharge lamp may be contemplated in which the front edge end of the inner ring section of the ring-shaped flange is protruded more forward than the window member, for example. This allows the front edge end of the inner ring section of the ring-shaped flange to be in contact with the table or the like even when the discharge lamp is placed on the table or the like with the window member facing down, thereby preventing the window member from being damaged.

However, the generation of crack occurs even in the discharge lamp having the example configuration described above for the following mechanism discussed below.

The window member and the ring-shaped flange are typically made of sapphire and a kovar metal, respectively. Hence, the circumferential side surface of the window member is subjected to metalization, following which a brazing material is introduced between the circumferential side surface of the window member and the inner circumferential surface of the inner ring section of the ring-shaped flange to bond the window member and the inner ring section together.

Figure 5:
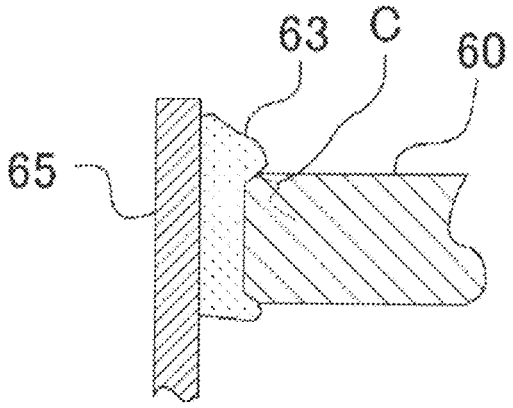
Related Art FIG.5
FIG. 5 is a schematic view for describing generation of crack in a window member.

In the configuration in which the ring-shaped flange is protruded more forward than the window member, however, the introduced brazing material flows along the ring-shaped flange toward a light emission surface of the window member upon manufacturing of the discharge lamp. As illustrated in FIG. 5, in the operation of the thus-manufactured discharge lamp, a portion of the ring-shaped flange (denoted by 65) in proximity to the window member (denoted by 60) receives inner pressure of the discharge space, thereby applying a tensile stress to the window member 60 through the bonding layer (denoted by 63) configured of the brazing material. As a result, the crack denoted by C is generated at corners of the light emission surface of the window member 60.

In contrast, the discharge lamp according to the present embodiment of the invention includes the front edge section 35*d* having the shape as described above. Thus, the window member 30 is not protruded forward, making it difficult to cause damage on the window member 30 even when the discharge lamp is placed on a table or the like with the window member 30 facing down. Also, the window supporting member 35 having the front edge section 35*d* provides the window supporting member 35 itself with increased strength. Hence, it is possible to suppress the generation of damage, crack, or the like of the window member 30.

Although the invention has been described in the foregoing by way of example with reference to some example embodiments, the invention is not limited thereto but may be modified in a wide variety of ways.

Figure 3:
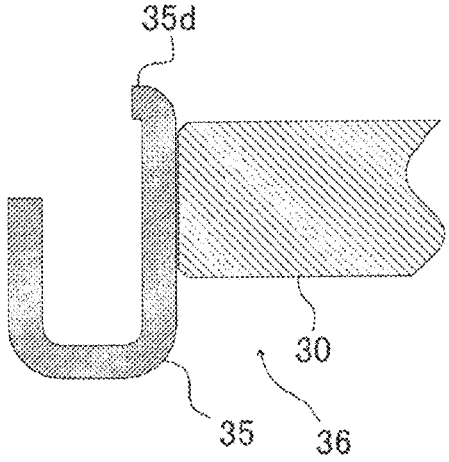
FIG. 3 is a cross-sectional view illustrating another example of a configuration of the window supporting member in the short arc discharge lamp according to an embodiment of the invention.

For example, the front edge section 35*d* has the shape bent inwardly in the radial direction of the window member 30 in the example embodiment described above. However, this is non-limiting and the front edge section 35*d* in one embodiment may have a shape bent outwardly in the radial direction of the window member 30 as illustrated in FIG. 3.

Furthermore, the invention encompasses any possible combination of some or all of the various embodiments described herein and incorporated herein.

EXAMPLES

In the following, specific Examples of the discharge lamp are described. It should be understood that these Examples are illustrative, and should not be construed as being limiting in any way.

Example 1

A short arc discharge lamp having the following specifications was manufactured, based on the configuration illustrated in FIGS. 1 and 2.

Body (body 20): made of polycrystalline alumina ($Al_2O_3$), 20 mm in overall length and 32 mm in outer diameter.

Cathode (cathode 22): made of thoriated tungsten, 1.5 mm in rod diameter, 14 mm in overall length, and 50 degrees in taper angle of a tip.

Anode (anode 23): made of tungsten, 4 mm in diameter and 23 mm in overall length.

Inter-electrode distance between the anode (anode 23) and the cathode (cathode 22): 1.4 mm.

Sealed gas: xenon gas at pressure of 2.0 MPa (in 25 degrees centigrade).

Window member (window member 30): made of sapphire, 24.89 mm in outer diameter, 3 mm in thickness, 0.7 mm in distance from a front end of a window supporting member (window supporting member 35).

Window supporting member (window supporting member 35): made of kovar, 5.65 mm in height, 31.5 mm in outer diameter of an outer ring section (outer ring section 35*b*), 26.3 mm in outer diameter of an inner ring section (inner ring section 35*a*), 0.65 mm in thickness, R0.5 to R1.2 in radius of a bending process of a front edge section (front edge section 35*d*), and 0.2 mm in width of the front edge section (front edge section 35*d*).

A placement test was conducted in which the discharge lamp described above was placed on a table with a light emission direction being directed downward, followed by visual observation of presence of damage on a surface of the window member. Thereafter, a lifetime test was conducted in which the same discharge lamp was turned on for ten minutes under the conditions of discharge lamp power of 300 watts and a lamp voltage of 14 volts and then turned off for five minutes, and in which a cycle of such turning on and off was performed 1200 times (performed for 300 hours). Following the lifetime test, the presence of crack of the window member was observed visually or using a magnifier. The following Table shows a result thereof.

Comparative Example 1

A short arc discharge lamp was manufactured that had the same configuration and specifications as those of the Example 1, with the exception that a window supporting member, in which a tip of an inner ring section is not protruded more forward than a window member, was used instead of the window supporting member 35 illustrated in FIG. 2. The placement test and the lifetime test were likewise performed as with the Example 1 to observe the presence of damage and crack of the window member. A result thereof is as shown in the following Table.

Comparative Example 2

A short arc discharge lamp was manufactured that had the same configuration and specifications as those of the Example 1, with the exception that a window supporting member, in which a tip of an inner ring section is protruded more forward than a window member and the tip of the inner ring section was not applied with the bending process, was used instead of the window supporting member 35 illustrated in FIG. 2. The placement test and the lifetime test were likewise performed as with the Example 1 to observe the presence of damage and crack of the window member. A result thereof is as shown in the following Table.

TABLE

| | Example 1 | Comparative Example 1 | Comparative Example 2 |
|---|---|---|---|
| Presence of Damage by Placement Test | No | Yes | No |
| Presence of Crack by Lifetime Test | No | Yes | Yes |

As is evident from the results shown in the Table, it was confirmed that the discharge lamp in the Example 1 suppressed the generation of damage and crack of the window member.

It is possible to achieve at least the following configurations from the above-described example embodiments of the invention.

(1) A short arc discharge lamp, including:

a body including therein a reflection surface and having a front opening;

a cathode and an anode that are opposed to each other in discharge space, the discharge pace being defined by the reflection surface surrounding the discharge space;

a window member provided in front of the body and covering the front opening; and a window supporting member including an inner ring section, an outer ring section, and a coupling section, the inner ring section being configured to allow a circumferential side surface of the window member to be fixed thereto, the outer ring section being larger in diameter than the inner ring section, the coupling section connecting the inner ring section and the outer ring section together, and the inner ring section including, in front of the window member, a front edge section having a shape bent in a radial direction of the window member.

(2) The short arc discharge lamp according to (1), wherein the window member is disposed in the front of the body through a metal ring, the metal ring being configured to supply power to the cathode.

(3) The short arc discharge lamp according to (2), wherein the coupling section of the window supporting member is fixed to the metal ring.

(4) The short arc discharge lamp according to any one of (1) to (3), wherein the window supporting member has a ring shape having a U-shaped cross-section.

(5) The short arc discharge lamp according to any one of (1) to (4), wherein the circumferential side surface of the window member is fixed to the inner ring section of the window supporting member through a bonding layer.

(6) The short arc discharge lamp according to any one of (1) to (5), wherein the shape of the front edge section includes a shape bent inwardly or outwardly in the radial direction of the window member.

(7) The short arc discharge lamp according to any one of (1) to (6), wherein the reflection surface is curved in a concave shape.

(8) The short arc discharge lamp according to any one of (1) to (7), wherein the inner ring section is tubular in shape, and the outer ring section is tubular in shape.

(9) The short arc discharge lamp according to any one of (1) to (8), wherein the front edge section is in indirect contact with the window member.

(10) The short arc discharge lamp according to any one of (1) to (9), wherein the front edge section is formed as a result of performing a bending process on a material that forms the inner ring section.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A short arc discharge lamp, comprising:

a body including therein a reflection surface and having a front opening;

a cathode and an anode that are opposed to each other in discharge space, the discharge space being defined by the reflection surface surrounding the discharge space;

a window member provided in front of the body and covering the front opening; and a window supporting member including an inner ring section, an outer ring section, a coupling section, and a front edge section, the inner ring section being configured to allow a circumferential side surface of the window member to be fixed thereto, the outer ring section being larger in diameter than the inner ring section, the coupling section connecting the inner ring section and the outer ring section together, and the front edge section including a front edge straight section and a front end bent section integrally connecting the inner ring section and the front edge straight section together, wherein the window member comprises an outer window surface defining a reference plane extending radially about a longitudinal axis extending through the anode and cathode, wherein the front edge straight section is rectangularly-shaped as viewed in cross-section and has an outer front edge straight section surface and an inner front edge straight section surface disposed opposite the outer front edge straight section surface to define a thickness therebetween, wherein the inner front edge straight section surface is disposed adjacent to yet apart from the reference plane at a distance d such that the inner front edge section is in indirect contact with the window member only the circumferential side surface of the window member and not at the outer window surface, wherein the distance d is greater than zero.

2. The short arc discharge lamp according to claim 1, wherein the window member is disposed in the front of the body through a metal ring, the metal ring being configured to supply power to the cathode.

3. The short arc discharge lamp according to claim 2, wherein the coupling section of the window supporting member is fixed to the metal ring.

4. The short arc discharge lamp according to claim 1, wherein the window supporting member has a ring shape having a U-shaped cross-section.

5. The short arc discharge lamp according to claim 1, wherein the circumferential side surface of the window member is fixed to the inner ring section of the window supporting member through a bonding layer.

6. The short arc discharge lamp according to claim 1, wherein the shape of the front edge section comprises a shape bent inwardly or outwardly in the radial direction of the window member.

7. The short arc discharge lamp according to claim 1, wherein the reflection surface is curved in a concave shape.

8. The short arc discharge lamp according to claim 1, wherein the inner ring section is tubular in shape, and the outer ring section is tubular in shape.

9. The short arc discharge lamp according to claim 1, wherein the front edge section is formed as a result of performing a bending process on a material that forms the inner ring section.

10. The short arc discharge lamp according to claim 1, wherein the front end bent section is bent inwardly towards the longitudinal axis such that the front edge straight section projects from the front edge bent section towards the longitudinal axis.

11. The short arc discharge lamp according to claim 10, wherein the front edge straight section projects rectilinearly from the front edge bent section towards the longitudinal axis.

12. The short arc discharge lamp according to claim 1, wherein the front end bent section is bent outwardly away from the longitudinal axis such that the front edge straight section projects from the front edge bent section and away from the longitudinal axis.

13. The short arc discharge lamp according to claim 12, wherein the front edge straight section projects rectilinearly from the front edge bent section and away from the longitudinal axis.

* * * * *